United States Patent [19]

Fowles

[11] 4,015,814

[45] Apr. 5, 1977

[54] FORMATION OF LUGS ON INGOT MOULDS

[75] Inventor: Edwin Fowles, Tarporley, England

[73] Assignee: Hilti Aktiengesellschaft, Schann, Liechtenstein

[22] Filed: Mar. 29, 1976

[21] Appl. No.: 671,107

[30] Foreign Application Priority Data

May 14, 1975 United Kingdom ..... 20283/75

[52] U.S. Cl. ..... 249/174; 29/401 R; 29/457; 29/526; 228/176; 228/182; 29/432

[51] Int. Cl.[2] ..... B22D 7/06

[58] Field of Search ..... 249/174; 164/92; 228/176, 135, 139, 140, 182, 178; 29/401 D, 401 A, 401 F, 457, 432, 401 R; 113/116 W, 116 AA, 116 DD

[56] References Cited

UNITED STATES PATENTS

| | | | |
|---|---|---|---|
| 1,865,284 | 6/1932 | Smith | 228/135 X |
| 1,952,217 | 3/1934 | Patton et al. | 228/182 X |
| 2,320,163 | 5/1943 | Anderson | 228/182 X |
| 2,761,201 | 9/1956 | Sylvester | 29/401 |
| 3,360,845 | 1/1968 | Buschmann | 164/92 X |
| 3,747,197 | 7/1973 | Riel | 228/178 X |

FOREIGN PATENTS OR APPLICATIONS

| | | | |
|---|---|---|---|
| 45-37431 | 11/1970 | Japan | 29/401 |
| 46-946 | 11/1971 | Japan | 29/401 |
| 1,365,697 | 9/1974 | United Kingdom | 29/401 R |

*Primary Examiner*—Ronald J. Shore
*Attorney, Agent, or Firm*—Toren, McGeady and Stanger

[57] ABSTRACT

For forming a lifting lug upon an ingot mould, either as a replacement for a broken-off lug on an existing mould or as a lug on a newly-produced mould formed in the first instance without lugs, a mounting plate is secured to the mould by fasteners driven through said plate and into the mould; then an array of fillets is welded to the plate in correspondence with and in conformity with the desired lug configuration; whereafter a consolidating plate is positioned to overlie the outer edges of the fillets and is welded to the latter.

4 Claims, 5 Drawing Figures

FORMATION OF LUGS ON INGOT MOULDS

BACKGROUND OF THE INVENTION

This invention concerns the formation of lifting lugs on ingot moulds of the kind used in steelworks, the lugs serving to enable the mould to be lifted from above by means of tongs which engage with the lugs.

OBJECT OF THE INVENTION

An object of the invention is to provide a method enabling such lugs to be formed (either on new moulds or as replacements for broken-off lugs for existing moulds) in a simple, convenient and relatively inexpensive manner.

BRIEF DESCRIPTION OF THE INVENTION

With this object in view, the present invention provides a method of forming a lifting lug on an ingot mould which comprises securing a weldable mounting plate to the mould by fasteners driven through the mounting plate and into the material of the mould, welding a plurality of fillets to the mounting plate so as to protrude therefrom in an array whose overall configuration corresponds to that of a lifting lug, positioning one or more consolidating plates across the outer edges of the fillets and welding them to said fillets.

BRIEF DESCRIPTION OF THE FIGURES OF THE DRAWINGS

The invention will be described further, by way of example, with reference to the accompanying drawings, in which.

DESCRIPTION OF THE EMBODIMENT ILLUSTRATED IN THE DRAWINGS

Figure 1:
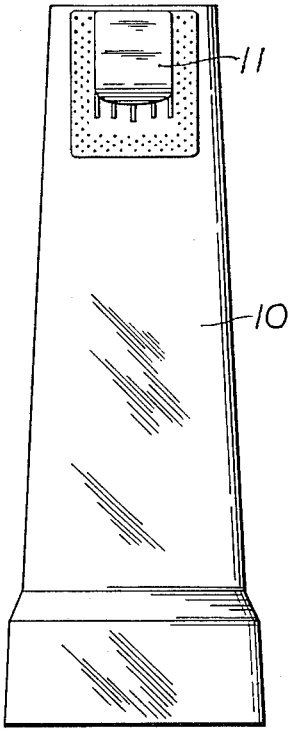
FIG. 1 is a side view of an ingot mould of which the lifting lugs have been formed in accordance with the invention.
Figure 2:
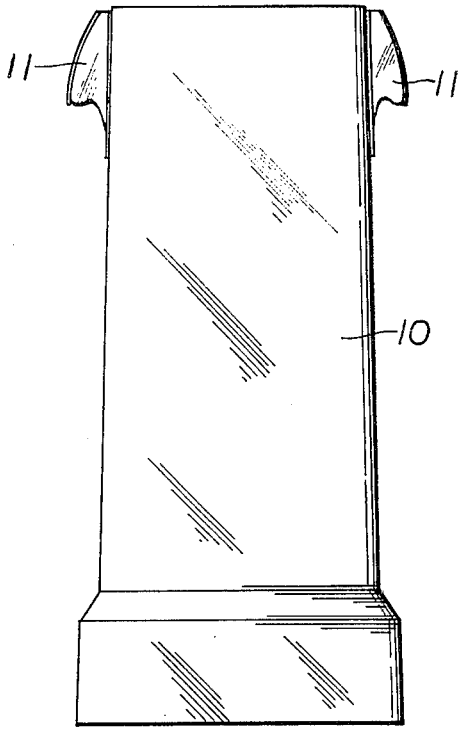
FIG. 2 is a front view of the ingot mould of FIG. 1.

Referring firstly to FIGS. 1 and 2, these figures illustrate an ingot mould 10 of the kind such as is used in a steelworks for casting steel billets. Such a mould 10 is of massive construction and is formed at its two opposite sides, near to its top, with lifting lugs 11 by which the mould 10 can be lifted by means of tongs suspended from an overhead crane (not shown).

In the prior known ingot moulds, the lifting lugs are usually integrally moulded. With the rough usage to which the moulds are put in a steelworks, it is not unusual for the lugs to become fractured or broken off with the result that the mould (which may cost upwards of 600 pounds) becomes useless.

Figure 3:
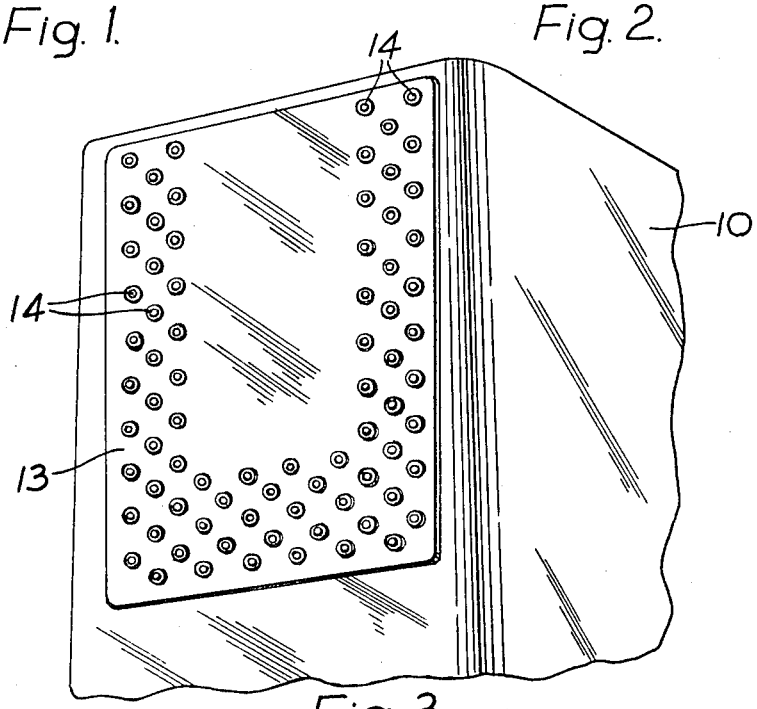
FIG. 3 is an enlarged fragmentary perspective detail illustrating a first stage in the formation of one of the lugs of the mould of FIGS. 1 and 2.
Figure 4:
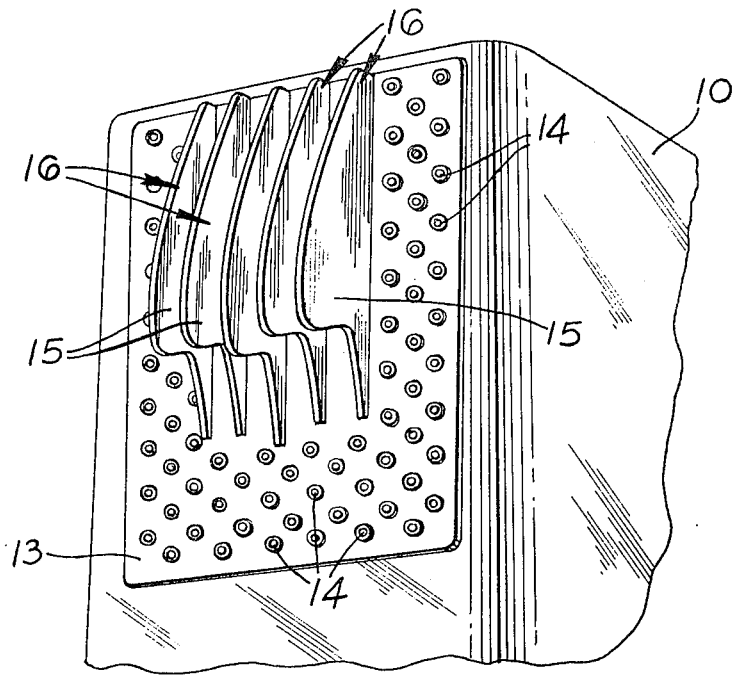
FIG. 4 is a view similar to FIG. 3 but showing a subsequent stage in the formation of the lug.
Figure 5:
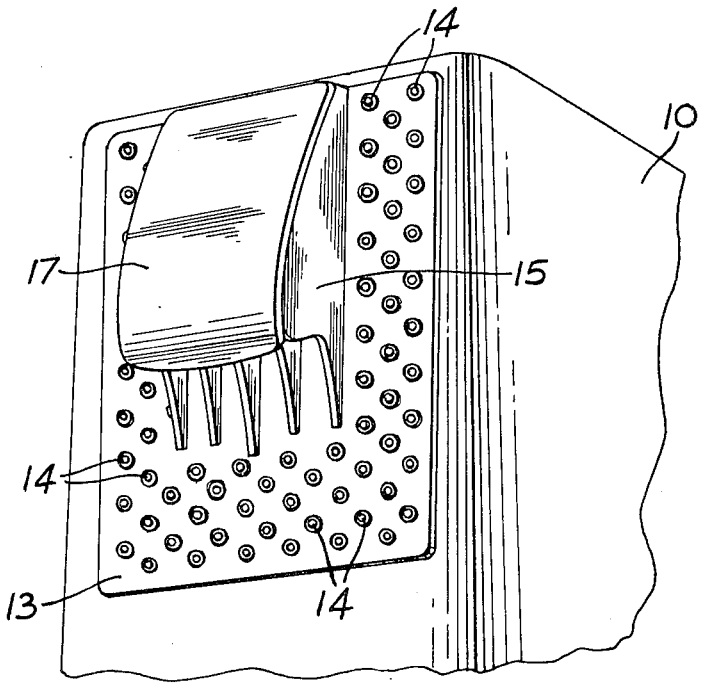
FIG. 5 is a view similar to FIGS. 3 and 4, but showing the lug completed.

FIGS. 3, 4 and 5 illustrate the steps involved in forming one of the lugs 11 on such an ingot mould, in accordance with the invention, it being possible, of course, to form the lug either as a replacement for a broken lug on an existing mould or as a lug on a newly-produced mould formed in the first instance without integral lugs.

Referring firstly to FIG. 3, as a first step in forming the lug, a weldable mounting plate 13 is fastened to the side of the mould 10 by means of a large number of fasteners 14 each in the form of a hardened steel nail driven through the plate 13 and into the material of the mould 10. Driving of the fasteners 14 can be effected by means of a cartridge-actuated fastener driving tool using known techniques.

The mounting plate 13 may be a unitary plate, or it may be in a number of sections nailed in place individually and then welded together.

The mounting plate 13 having been secured in position, as shown in FIG. 4, a plurality of fillets 15 are welded to the mounting plate 13 in a parallel array. These fillets 15 are shaped, of course, each to have an outer curved edge 16 conforming to the usual lateral outer surface of a conventional lug viewed as in FIG. 2 and they are welded to the plate 13 so as to occupy an overall area corresponding to the area which would be occupied by such a conventional lug. It will be understood, of course, that the region of the plate 13 to which the fillets 15 are welded will be free of fasteners 14, but of course further such fasteners can be driven through the plate 13 and into the mould in the spaces between the fillets 15 if required.

The welding of the fillets 15 having been completed, a consolidating plate 17, shaped to conform to the outer curved edges 16 of the fillets 15*k* is overlaid upon such outer curved edges as illustrated in FIG. 5 and is welded in place by weld seams connecting it to each of said fillets 15.

The lug as so formed is used for enabling the mould to be lifted from above by means of tongs, suspended, for example, from an overhead travelling gantry, in exactly the same way as with moulds having intergrally-formed lugs formed in conventional manner. The lugs formed in accordance with the invention have a considerable useful life, and in the event of damage to a part thereof repair by welding can be effected without difficulty. In the event of major damage to the entire lug, the plate 13 can be levered off the mould and a fresh lug can be fabricated in the place thereof in accordance with the abovedescribed steps.

I claim:

1. A method of forming a lifting lug on an ingot mould which comprises the steps of:

a. securing a weldable mounting plate to said mould, in the desired location for said lug, by fasteners driven through said mounting plate and into the material of said mould;

b. welding to said mounting plate a plurality of elongate fillets each shaped to provide a substantially linear liner edge for contacting said mounting plate and a curved and lobe-shaped outer edge, in an array whose overall configuration conforms to the desired lifting lug shape, said welding being effected along said linear edges of said fillets;

c. positioning a consolidating plate across the said outer edges of said fillets; and d. welding said consolidating plate to said outer edges of said fillets.

2. A method as set forth in claim 1 wherein said mounting plate comprises a plurality of sections, the securing of said mounting plate being effected by securing said sections in place individually by means of said fasteners, and thereafter welding said sections together.

3. A method as set forth in claim 1 wherein said fillets are arranged parallel to one another in said array.

4. An ingot mould having a lifting lug which comprises:

a mounting plate secured to said mould by fasteners driven through said mounting plate and into the material of said mould;

a plurality of elongate fillets welded to said mounting plate and projecting therefrom in an array whose overall configuration corresponds to the overall configuration of said lifting lug, each said fillet providing a substantially linear edge by which it is welded to said mounting plate and a lobe-shaped outer edge; and a colsolidating plate overlying said outer edges of said fillets and welded thereto.

* * * * *